US005609412A

United States Patent [19]

Contigiani

[11] Patent Number: 5,609,412

[45] Date of Patent: Mar. 11, 1997

[54] LIGHTING SYSTEMS FOR CHRISTMAS TREES

[76] Inventor: Frank Contigiani, 2020 Mac Larie La., Broomall, Pa. 19008

[21] Appl. No.: 530,703

[22] Filed: Sep. 19, 1995

[51] Int. Cl.[6] ..... F21V 21/14

[52] U.S. Cl. ..... 362/249; 362/123; 362/806

[58] Field of Search ..... 362/122, 123, 362/249, 250, 252, 806; 428/18, 19, 20

[56] References Cited

U.S. PATENT DOCUMENTS

| | | | |
|---|---|---|---|
| 2,052,425 | 8/1936 | Simeone | 362/250 |
| 2,802,095 | 8/1957 | Denning et al. | 362/250 |
| 4,040,621 | 9/1983 | Mauro | 362/123 |
| 4,462,065 | 7/1984 | Rhodes | 362/123 |
| 5,442,531 | 8/1995 | Lee | 362/249 |

*Primary Examiner*—Ira S. Lazarus
*Assistant Examiner*—Alan B. Cariaso
*Attorney, Agent, or Firm*—Woodcock Washburn Kurtz Mackiewicz & Norris

[57] ABSTRACT

A lighting assembly for decorating a tree in combination with a storage box for storing the lighting assembly. The combination comprises a plurality of support members having a generally elongated U-shaped cross-section for receiving a string of lights having a plurality of light bulbs held in sockets. Each support member is made from a plastic material and formed to be placed on a tree branch. Each support member has a relative inner portion and a relative outside portion defining at least one channel. The channel is formed in at least the relative outside portion of said support member for receiving a string of lights. The channel is formed such that when each support members is assembled with a string of lights, the light bulbs will be supported relatively parallel to the tree branch. At least one string of lights having a plurality of light bulbs held within sockets is secured within at least one channel. Each support member and string of lights can be placed within a storage box. The box has a base and a boss protruding relatively upwardly from said base. The boss is formed such that each support member and string of lights can be placed one on top of the other without damaging the lights bulbs.

20 Claims, 6 Drawing Sheets

LIGHTING SYSTEMS FOR CHRISTMAS TREES

FIELD OF THE INVENTION

This invention relates generally to decorative lights, and more particularly to a string of decorative lights that can be stored without damaging the bulbs and without forming tangles along the length of the string of lights.

BACKGROUND OF THE INVENTION

In celebration of holidays, birthdays and other parties, it is common for people to decorate their home, office, and other locations. Christmas is a specific holiday that many people celebrate. In celebrating this holiday, a substantial number of people happily decorate their homes. An evergreen tree, real (real christmas tree) or artificial (artificial christmas tree), is a particular decorative ornament that is almost always displayed. Both the real and artificial christmas trees are further dressed with decorative bulbs, tinsel, garland, a string of lights, and other ornaments.

Many people have christmas tree trimming parties so that friends and family can be together in celebration. During this joyous time, the guests decorate the tree. It is highly probable, however, that any excitement during this time will be diminished because of a set of tangled up string of christmas lights.

After the string of christmas lights are removed from storage, these lights generally can not be immediately placed on a christmas tree because they are tangled or knotted. It is therefore an objective of the inventor to provide a string of lights that can be immediately put on a tree after being removed from storage.

Some people become so frustrated because of all of the tangles and knots in the old string of lights that they throw the old lights away and then purchase new strings of lights. It is therefore an objective of the inventor to provide a set of string of lights that are reusable.

If the old string of lights is not thrown away, a person may notice that after untangling the string of lights that it is difficult to place the lights evenly on the tree. It is therefore another objective of the inventor to provide a string of lights that can be placed evenly on a tree.

After the prior art string of lights are placed on the christmas tree, it is highly likely that at least one of the light bulbs has been broken during storage. The light bulbs can easily be broken because the lights can not be stored safely. It is therefore, another objective of the inventor to provide a string of lights that can be safely stored.

Additional objectives of the inventor and advantages of the invention will be set forth in part in the description which follows, and in part will be obvious from the description, or may be learned by practice on the invention. The objectives of the inventor and advantages of the invention may be realized and attained by means of the instrumentalities and combinations particularly pointed out in the appended claims.

SUMMARY OF THE INVENTION

To achieve the objectives and in accordance with the purpose of the invention as embodied and broadly described herein, one embodiment of a lighting assembly used for decorating a tree comprises a plurality of support members for receiving a string of lights having a plurality of light bulbs held in sockets. Each support member is made from a plastic like material and formed to be placed on a tree branch. Each support member has a relative inner portion and a relative outer portion which defines at least one channel having an opening. A channel opening is formed at least in the relative outer portion of the support member such that a string of lights can be received therein. The channel is formed such that when the support member and string of tree lights are assembled together and placed on a tree branch, the light bulbs will be supported relatively parallel to the tree branch.

Another embodiment of a lighting assembly for decorating a tree comprises at least one string of lights having decorative light bulbs, and a plurality of support member for receiving each string of lights. Each support member is made from a plastic like material and formed to be placed on a tree branch. Each support member has a relative inner portion and a relative outer portion which defines at least one channel having an opening. The channel opening is formed at least in the relative outer portion of the support member such that each string of lights can be received therein. The channel is formed such that when the support member and string of tree lights are assembled together and placed on an tree branch, the light bulbs will be supported relatively parallel to the tree branch. Each string of lights is securely placed within at least one channel.

Another embodiment of the invention comprises at least one string of lights having decorative light bulbs, a plurality of support members for receiving each string of lights, and a box for storing the string of lights and the support members. Each support member is made from a plastic like material and formed to be placed on a tree branch. Each support member has a relative inner portion and a relative outer portion which defines at least one channel having an opening. The channel opening is formed at least in the relative outer portion of the support member for receiving a string of lights. The channel is formed such that when the support member and string of tree lights are assembled and placed on an tree branch, the light bulbs will be supported relatively parallel to the tree branch. At least one string of lights is provided and placed in and secured within at least one channel. Additionally, a storage box is provided for storing each support member and string of lights. The box has a base and a boss protruding relatively upwardly from the base. The boss is formed such that each support member and string of lights can be placed one on top the other without damaging the lights bulbs.

BRIEF DESCRIPTION OF THE DRAWINGS

The accompanying drawings which are incorporated in and constitute a part of the specification, illustrate at least one embodiment of the invention and together with the description, serve to explain the principles of the invention.

The invention will now be further described by way of example, with reference to the accompanying drawings, in which.

DETAILED DESCRIPTION OF TEE PREFERRED EMBODIMENT

Reference will now be made in detail to the present preferred embodiment of the invention, an example of which is illustrated in the accompanying drawings. It is noted that like materials or parts are designated by the same numeral throughout the drawings.

Figure 1:
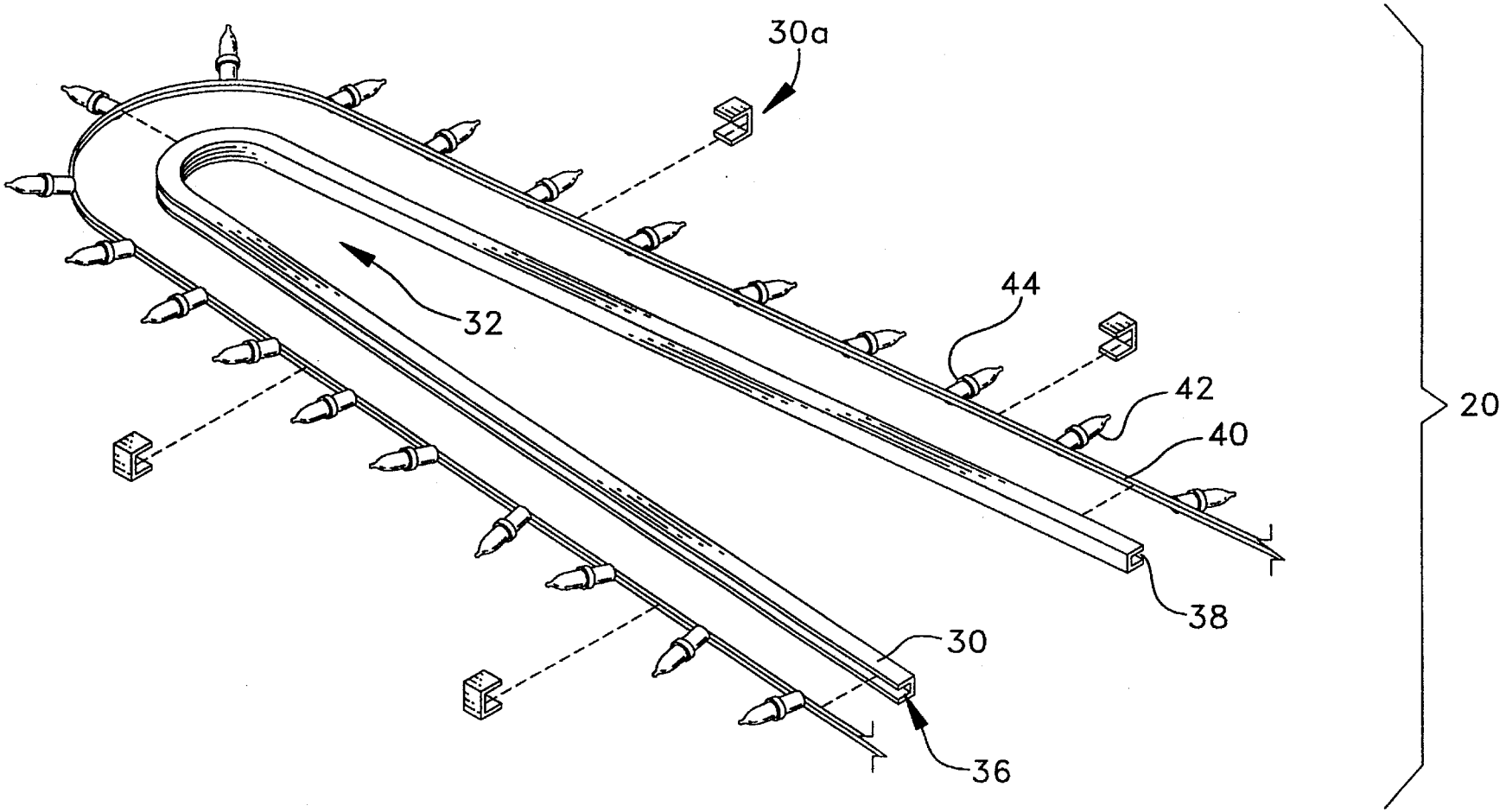
FIG. 1 is an exploded view of the preferred embodiment of the invention.
Figure 2:
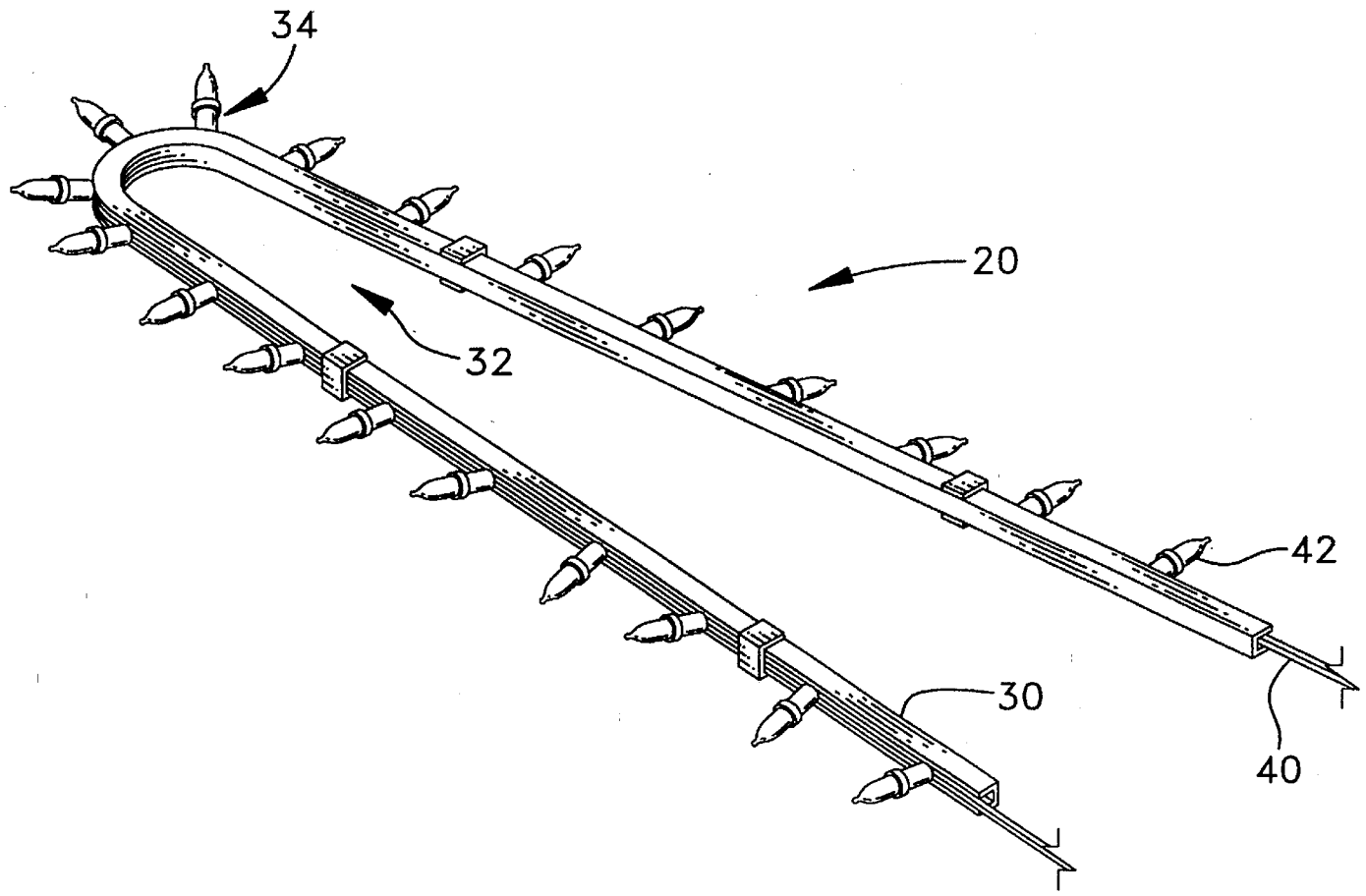
FIG. 2 is perspective view of the embodiment in FIG. 1.
Figure 3:
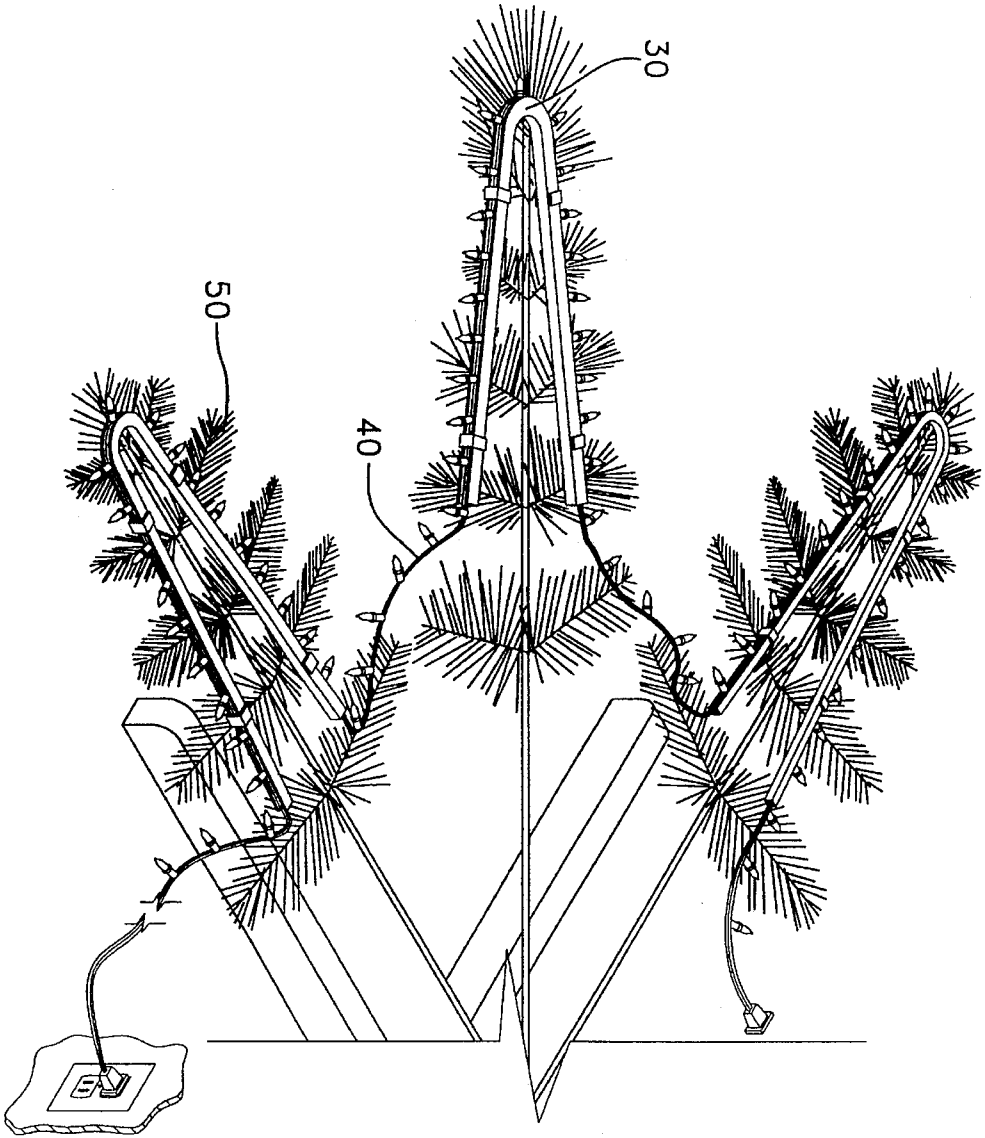
FIG. 3 is a perspective view of the embodiment in FIG. 2 in operation.

The preferred embodiment of the lighting assembly for decorating a tree is shown in FIGS. 1, 2 and 3 and is represented generally by the numeral 20. The lighting assembly 20 comprises a plurality of support member 30 for receiving a string of electric lights 40 having a plurality of decorative light bulbs 42 held within sockets 44 and an electric socket plug. Each support member 30 can be formed in many shapes and sizes. The preferred support member has a generally elongated U-shape cross-section which is formed to be placed on a tree branch 50, such as a real or an artificial evergreen tree. The support member 30 can be made from any plastic like material, such as PVC and polyethylene, so that each support member is flexible enough to enable the support member to be manipulated to fit onto branches having different widths and lengths. In addition, the support member 30 is formed such that it may be cut to fit onto a small tree branch.

Each support member 30 has a relative inner portion 32 and a relative outer portion 34 which define at least one channel 36. The channel 36 has an opening 38 that is formed at least in the relative outer portion 34 of the support member 30. The channel opening 38 is formed such that most commercially available strings of decorative lights 40 can be secured therein. Additionally, the channel 36 is formed such that when the support member 30 and the string of decorative lights 40 are assembled and placed on a tree branch 50, the light bulbs 42 will be supported relatively parallel to the tree branch 50.

A plurality of fasteners or clips 30*a* for securing the string of tree lights within each of the channels may also be provided. A second set of fasteners can also be provided to fasten the support member and light assembly to the tree branch.

Further, the support member may have a color layer that is aesthetically pleasing or which permits each support member to blend in with the color of a particular tree, tree branch, or leave. For example, the support member can be colored with an appropriate green like color that matches the color of a real or artificial christmas tree, or have a substantially white color to blend in with a white artificial christmas trees.

The preferred embodiment will now be described in operation with an artificial evergreen tree. The preferred embodiment would be best applied with an artificial evergreen tree that must be assembled one branch at a time. A typical artificial tree has a stand, a tree trunk having insertion holes for receiving branches, and different size branches that are inserted into the holes in the tree trunk and when attached therein form a replica of a real evergreen tree.

The assembling of the lighting assembly consists of placing a string of decorative lights within the support member channel opening 38. Some of the support members 30 may be cut to either fit onto small branches or to otherwise further decorate the tree; i.e. placing more than one support member on a single branch, etc. The fasteners or clips 30*a* are then fitted within the channel or over the channel to prevent the string of lights from separating from the support member. An appropriate length or portion of the string of lights may be left between the support members (see FIG. 3) such that the lighting assembly can be maneuvered along the tree. This operation is continued until the entire string of lights is secured with each individual support member.

After the lights and support members are assembled, the support members are placed on individual branches until all of the support members are positioned on a branch. The support members are situated such that the light bulbs are supported relatively parallel to the branch. This allows the light from the bulb to shine outwardly from the tree when the string of lights is plugged into an electrical socket and turned on.

One type of string of lights that is commercially available measures 45 feet long having 100 decorative lights, therefore several support members would be needed to hold the entire string of lights. The length of the support members that the lights are placed in would vary in length as the lighting assembly is placed on the tree. Longer support members may be used on the longer branches while shorter support members may be used on shorter branches.

Alternatively, the string of lights can come in various ranges of lengths and sizes. As an example, a string of lights of 48 inches long can be placed in a corresponding support member. The string of lights would comprise opposite ends having an electrical connector and a receptacle. The string of lights may also be formed to have either both electrical connectors or both receptacles. After several support members are matched with the string of lights, coupling wires would be used to connect two sets of support members and lights.

Figure 4:
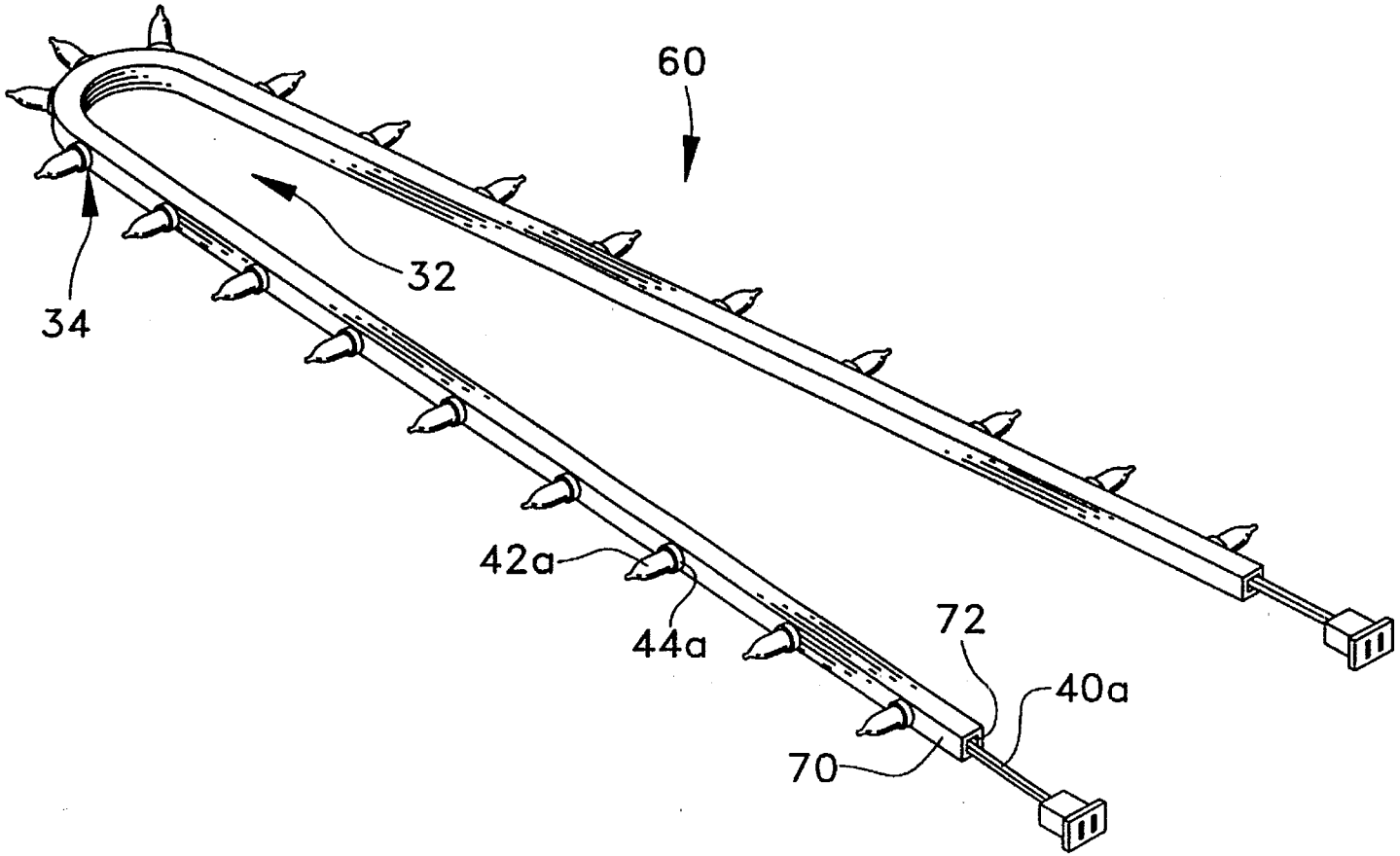
FIG. 4 is a perspective view of another embodiment of the present invention.
Figure 5:
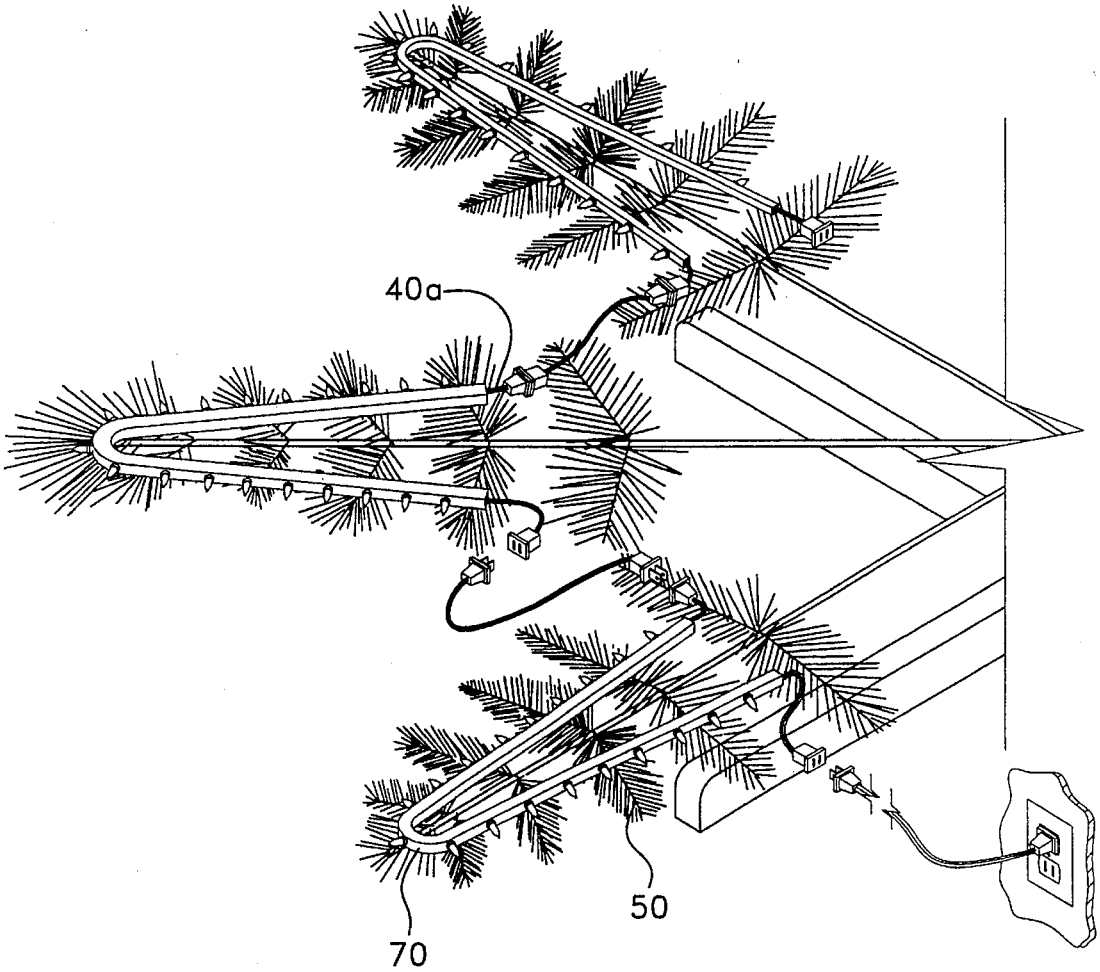
FIG. 5 is a perspective view of the embodiment in FIG. 4 in operation.
Figure 6:
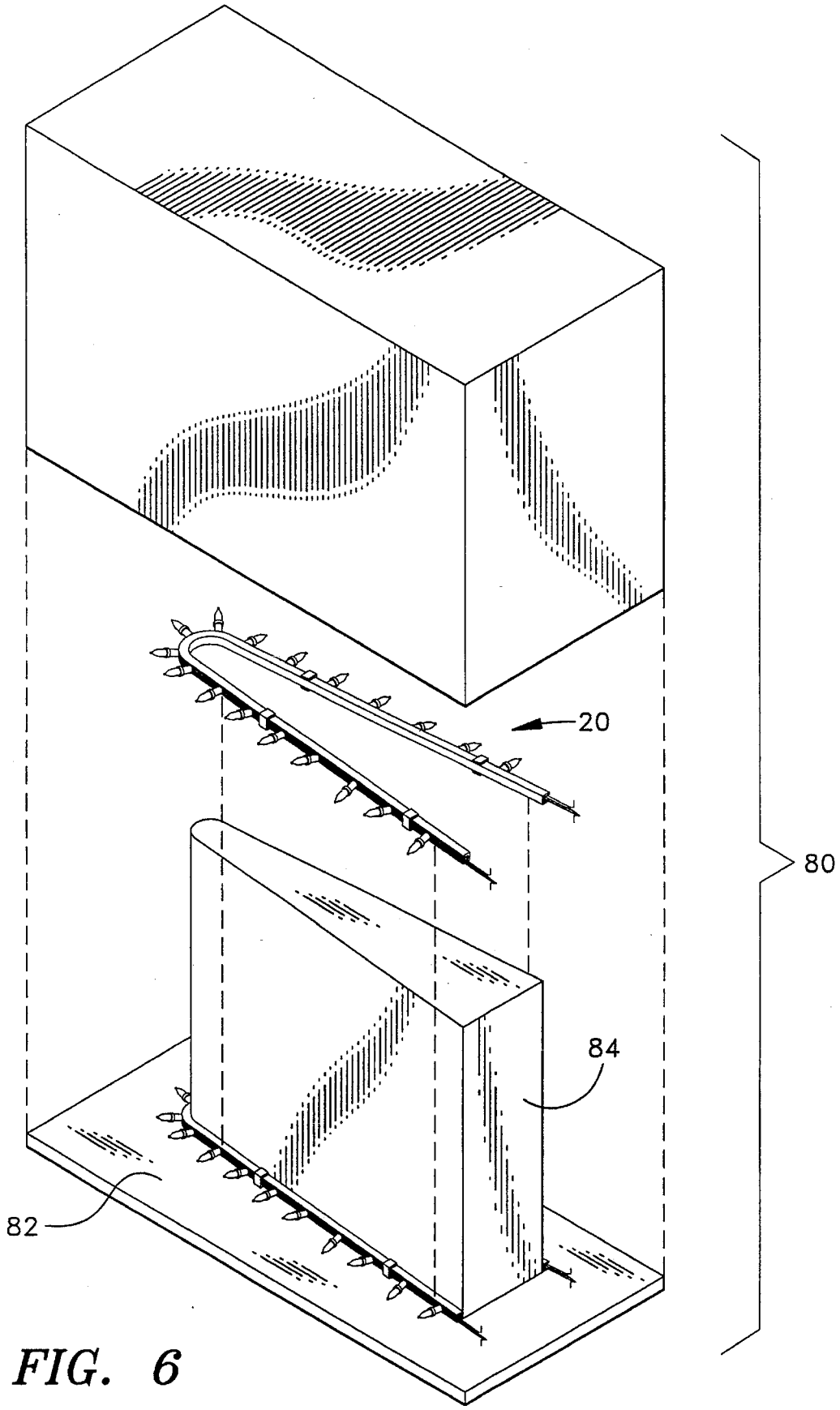
FIG. 6 is an exploded view of FIG. 2 in combination with a storage box.

An alternative embodiment of the present invention of the lighting assembly for decorating a tree is shown in FIGS. 4 through 6 and is represented generally by the numeral 60. The electrical lighting assembly comprises a plurality of support members 70 and a string of lights 40*a* having a plurality of light bulbs 42*a* held within sockets 44*a*.

Each support member can be formed in many shapes and sizes. Preferably, the support member 70 has a generally elongated U-shape cross-section which is formed to be placed on a tree branch 50, such as a real or an artificial evergreen tree. The support member can be made from any plastic like material, such as PVC and polyethylene so that the support member has enough flexibility that it can be manipulated to fit on branches having different widths and lengths.

Each support member 70 has a relative inner portion 32 and a relative outer portion 34 which define at least one channel 72. Preferably, each support member 70 is formed such that the string of decorative lights 40 is encased within the channel as shown in FIG. 4. Alternatively, if the lights are not encased, they can be secured within the channel with clips. The channel 72 is formed such that when the string of lights are encased therein, the decorative light bulbs will be facing in the relatively outer portion direction. In addition, when the support member 70 and the string of decorative lights 40*a* are placed on a tree branch 50, the light bulbs 42 will be supported relatively parallel to the tree branch 50.

As shown in FIG. 4, the string of lights 40*a* further comprise opposite ends having an electrical connector 46 and connector receptacle 48. The string of lights 40*a* may also be formed to have either both electrical connectors 46 or both receptacles 48. A coupling wire may be used to enable each support member and light set to be connected with another support member and light set and later disconnected in preparation for storage stored. When several support members and lights are connected, a chain of decorative lights will be formed sufficient in length to enable a person to adequately decorate a tree.

Additionally, the support member may have a color layer that is aesthetically pleasing or that permits each support member to blend in with the color of a particular tree, tree branch, or leaves. For example, the support member can be colored with an appropriate green like color that matches the color of a real or artificial christmas tree.

Moreover, a storage box 80, as shown in FIG. 6, can be provided for storing each of the support members and string of lights secured therein. The box is preferably made of a relatively strong light weight material such as polystyrene and like materials. The box has a base 82 and a boss 84 protruding relatively upwardly from the base. The boss 82 can be formed in any shape that corresponds to the shape of each support member and string of lights and which allows both the support members and lights to be placed one on top the other without having the light bulbs damaged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A lighting assembly for receiving a string of lights having alight bulbs held in a socket and used as a decorating ornament on a tree, a lighting assembly comprising:

a plurality of support members for receiving a string of lights, each of said support member being semi-flexible such that each support member may be manipulated to fit on different size tree branches; said support member having a relative inner portion and a relative outer portion defining at least one channel having an opening, said channel opening formed at least in the relative outer portion of said support member for receiving a string of lights, said channel formed such that when the support member and a string of tree lights are assembled and placed on a tree branch, the light bulbs will be supported relatively parallel to the tree branch.

2. The assembly of claim 1 wherein said support members have a generally elongated U-shaped cross-section.

3. The assembly of claim 1 further comprising:

a plurality of string of lights having light bulbs held within sockets.

4. The assembly of claim 1 further comprising:

a plurality of fasteners for fastening a string of tree lights within each of said channels.

5. The assembly of claim 1 wherein each of said support members is made of a PVC material.

6. The assembly of claim 1 wherein each of said support members has a relatively green color.

7. A tree lighting assembly for decorating a tree, the lighting assembly comprising:

a plurality of support members for receiving a string of lights, each of said support member being semi-flexible such that each support member may be manipulated to fit on different size branches; said support member having a relative inner portion and a relative outer portion defining at least one channel having an opening, said channel opening formed at least in the relative outer portion of said support member for receiving a string of lights, said channel formed such that when the support member and a string of tree lights are assembled and placed on a tree branch, the light bulbs will be supported relatively parallel to the tree branch; and at least one string of lights, said string of lights having a plurality of bulbs held within sockets, said string of lights secured within at least one channel.

8. The assembly of claim 7, wherein said support members have a generally elongated U-shaped cross-section.

9. The assembly of claim 7, wherein each of said string of tree lights is substantially encased within each of said support members.

10. The assembly of claim 7, wherein each of said string of lights has opposite ends having a connector and connector receptacle such that each string of lights can be removably connected in series, thereby allowing each support member and light assembly to be disconnected from each other string of lights and then stored.

11. The assembly of claim 7, wherein each of said support members is made of a PVC material.

12. The assembly of claim 7, wherein each of said support members has a relatively green color.

13. A lighting assembly for decorating a tree in combination with a storage box for storing the lighting assembly, the combination comprising:

a plurality of support members for receiving a string of lights having a plurality of light bulbs held in sockets, each of said support members formed to be placed on a tree branch; said support member having a relative inner portion and a relative outside portion defining at least one channel, said channel formed in at least the relative outside portion of said support member for receiving a string of lights, said channel formed such that when each of said support members is assembled with a string of lights, the light bulbs will be supported relatively parallel to the tree branch;

at least one string of lights having a plurality of light bulbs held within sockets, said string of lights secured within at least one channel; and a storage box for storing each of said support members and string of lights secured therein; said box having a base and a boss protruding relatively upwardly from said base, said boss formed such that each support member and string of lights can be placed one on top of the other without damaging the lights bulbs.

14. The assembly of claim 13, wherein said support members have a generally elongated U-shaped cross-section.

15. The assembly of claim 13, wherein each of said string of lights is substantially encased within each of said support members.

16. The assembly of claim 13, wherein each of said string of lights has opposite ends having a connector and connector receptacle such that each string of lights can be removably connected in series, thereby allowing each support member and light assembly to be disconnected from each other string of lights and then stored within said box.

17. The assembly of claim 13, wherein each of said support members is made of a PVC material.

18. The assembly of claim 13, wherein each of said support members has a relatively green color.

19. The assembly of claim 1 wherein each of said support members may be cut to fit on branches of different lengths.

20. The assembly of claim 7 wherein said string of lights are removably secured within said channel.

* * * * *